United States Patent [19]

Henning

[11] Patent Number: 4,997,163

[45] Date of Patent: Mar. 5, 1991

[54] NAIL PULLER

[76] Inventor: Richard H. Henning, 250 Rounsville St., Waupun, Wis. 53963

[21] Appl. No.: 498,413

[22] Filed: Mar. 26, 1990

[51] Int. Cl.[5] ..... B66F 15/00

[52] U.S. Cl. ..... 254/22

[58] Field of Search ..... 254/18, 19, 21–27

[56] References Cited

U.S. PATENT DOCUMENTS

| | | | |
|---|---|---|---|
| 82,568 | 9/1868 | Tyzick et al. | 254/22 |
| 222,295 | 12/1879 | McKeever | 254/22 |
| 943,322 | 12/1909 | Soles | 254/22 |

*Primary Examiner*—Robert C. Watson

*Attorney, Agent, or Firm*—Donald Cayen

[57] ABSTRACT

A nail puller pulls nails from a board or the like by gripping the nail shank. The nail puller comprises a block with a gripping surface and a foot that is pivotally connected to the block. A long handle is joined to the foot. The foot and handle are pivotable to an open configuratoin whereat a space is defined between the block gripping surface and the foot. With the foot in the open configuration, the space is positioned over the nail shank, and the nail puller is lowered onto the board or the like. The handle and foot are pivoted to a closed configuration whereat the foot is proximate the block gripping surface to grip the nail shank therebetween. A strong force applied to the handle causes the block and foot to rotate as a unit about a fulcrum on the board or the like to pull out the nail. The undersurface of the block is curved such that the block rolls along the board or the like as it rotates to extract the nail. The foot or block gripping surface may be serrated to better grip the nail shank.

2 Claims, 2 Drawing Sheets

FIG. 1
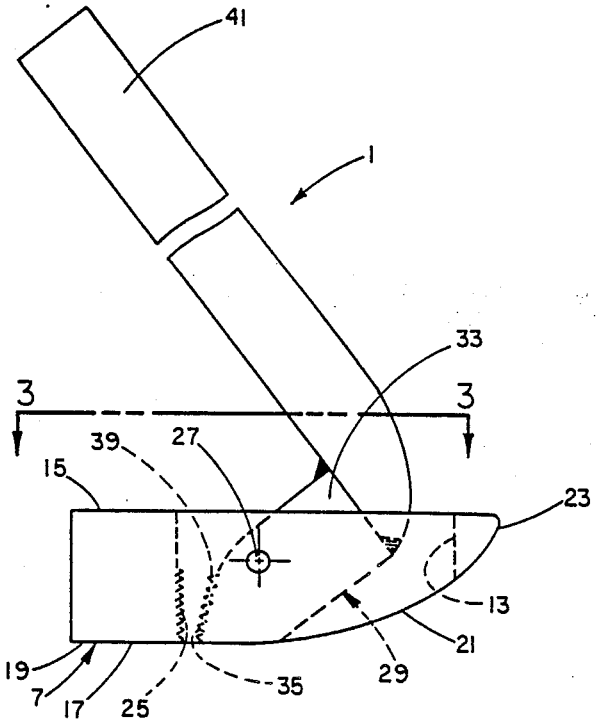
FIG. 2
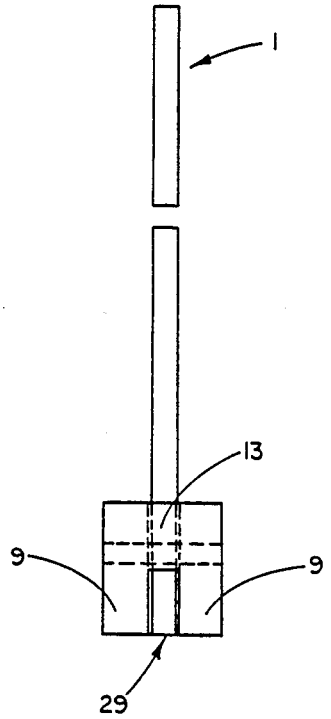
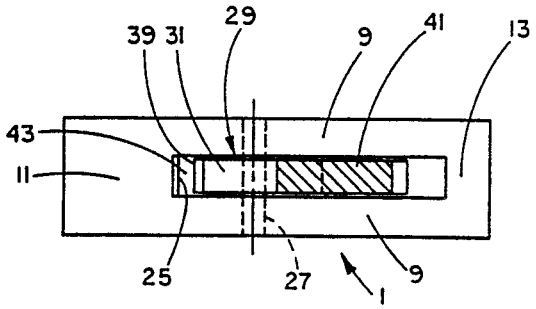
FIG. 3
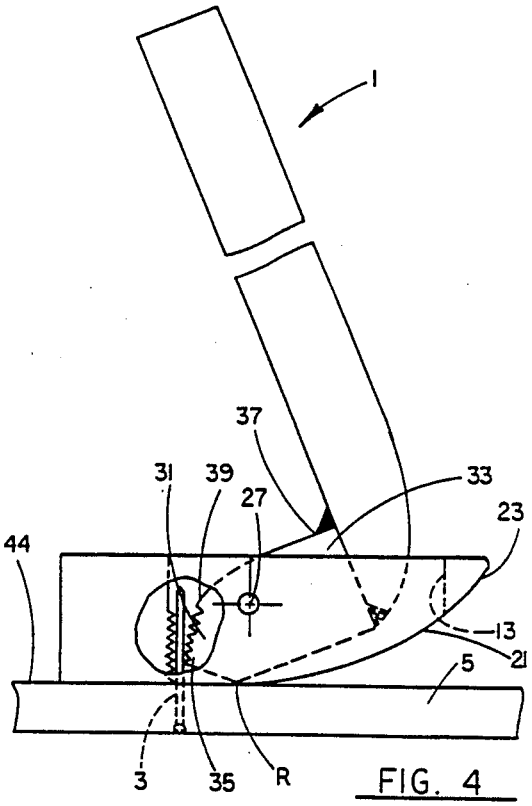
FIG. 4

NAIL PULLER

BACKGROUND OF THE INVENTION

1. Field of the Invention.

This invention pertains to hand tools, and more particularly to apparatus for pulling nails.

2. Description of the Prior Art.

Various tools have been developed to pull nails from boards and other materials. For example, claw hammers are well known. Other tools for pulling nails are described in U.S. Pat. Nos. 746,083; 779,919; 1,114,837; 1,910,203; and 3,026,901.

The tools of the foregoing patents, as well as all other tools known to me that are designed specifically for pulling nails, achieve their objective by pulling from under the nail head. If the nail head is flush with or below the surface of the board or the like, it is necessary that the complete head be exposed before any of the prior tools can be used. Sometimes it is possible to pound the nail tip to back the nail and expose the head above the board surface so that the head underside is accessible with a claw, fork, or similar tool. In other cases, access to the head can be obtained only by gouging out the wood or other material from around the head. Some tools are specifically designed to penetrate the wood around a nail head.

The prior procedures and tools are entirely satisfactory for a great many nail pulling applications. However, some applications require that considerable care be exercised in pulling a nail. For instance, restoration work often requires that decorative trim boards and moldings be saved and reused. Consequently, damage to their exposed finished surfaces must be avoided. Since nails used in decorative work are often recessed below the exposed surface, traditional nail pulling tools and methods are not acceptable. Pounding a nail pointed end to back the recessed head out of a board for gripping with a hammer or other tool frequently splits the wood adjacent the nail and raises splinters from the board along with the nail. Although it is often possible to glue the splinter back into place and refinish the damage, such a procedure is prohibitably time consuming and expensive.

Even if a nail head is accessible to the claws of a hammer or other prior tool, the tool invariably uses the finished surface as a reaction member for pulling the nail. The reaction force exerted at the tool fulcrum between the board finished surface and the tool is likely to mar the surface.

In some instances, it is possible for a person to pull nails from the back side of a board or trim piece with hand pliers. Pliers can also be used to pull a nail from the board finished surface by gripping the exposed head. However, those practices require a great deal of strength, and they are generally unsatisfactory.

Thus, a need exists for improvements in tools for pulling nails.

SUMMARY OF THE INVENTION

In accordance with the present invention, a nail puller is provided that removes nails from a board or the like without causing any damage to the board finished surface. This is accomplished by apparatus that includes a block and a foot that are pivotally connected to grip a nail shank therebetween and to rotate about the block to pull the nail.

The block is preferably designed with a generally U-shape having a pair of side legs and a connecting middle leg. The undersurface of the block middle leg is generally flat, and the undersurfaces of the side legs are curved.

The foot is pivotally connected to the block between the two side legs thereof. The foot has a toe end and a heel end. To the foot heel end is joined a long handle. By pivoting the handle, the foot pivots within the block. The foot is pivotable between a closed configuration whereat the toe of the foot contacts the middle leg of the block and an open configuration whereat the foot toe and block middle leg define a space between them.

In operation, the handle is rotated to place the foot in the open configuration. The puller is positioned such that the space between the foot toe and block middle leg is over the shank of the nail to be pulled. The nail puller is lowered to contact the back surface of the board or the like with the block flat undersurface, with the nail shank extending through the space between the foot toe and the block middle leg. Then the handle is pivoted to cause the foot to pivot to the closed configuration such that the nail shank is gripped between the foot toe and the block middle leg. Additional force is applied to the handle to cause the block to rotate and roll along its curved undersurface on the board back surface. Simultaneously, the foot and handle rotate as a unit with the block. That action causes the nail to be pulled from the board from the pointed end thereof, thereby pulling the head through the board without damaging the board finished surface.

It is a feature of the present invention that even a long nail can be pulled straight out of a board without the use of any additional aids. After pulling the nail a short distance as described above, handle pivoting is reversed to place the foot in the open configuration. The puller is repositioned such that the block flat undersurface is again against the board back surface. The handle is pivoted to regrip the nail between the shoe and the block at a new location on the shank proximate the board back surface. Force is reapplied to the handle to again roll the block along the board back surface and pull the nail farther out of the board. In that manner, the nail puller is able to ratchet the nail out in a substantially straight manner, which reduces both the force required on the handle and any potential damage to the board.

To increase the gripping force on the nail, the toe of the foot or the cooperating surface of the block middle leg, or both, may be serrated. Further, the block serrations may be formed as a strip that is removably fastened to the block. If desired, the free ends of the block side legs may be connected with a brace.

Other advantages, benefits, and features of the invention will become apparent to those skilled in the art upon reading the detailed description of the invention.

BRIEF DESCRIPTION OF THE DRAWINGS

FIG. 1 is a side view of the present invention with the foot thereof shown in the open configuration.

FIG. 2 is an end view of FIG. 1.

FIG. 3 is a cross sectional view taken along lines 3—3 of FIG. 1.

FIG. 4 is a partially broken side view similar to FIG. 1, but showing the foot in a closed configuration over a nail.

FIG. 5 is a view similar to FIG. 4, but showing a nail partially pulled from a board or the like.

DETAILED DESCRIPTION OF THE INVENTION

Figure 7:
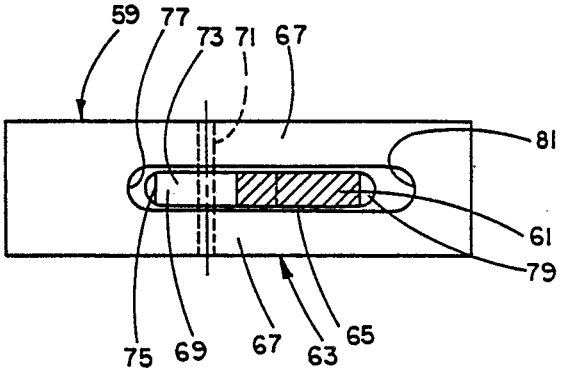
FIG. 7 is a view similar to FIGS. 3 and 6, but showing a further modified embodiment of the invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1-4, a puller 1 is illustrated that includes the present invention. The puller is particularly useful for removing nails 3 from a board 5 or similar item, but it will be understood that the invention is not limited to carpentry applications.

The puller 1 comprises a block 7 that preferably is generally U-shaped, having side legs 9 and a middle leg 11. If desired, the free ends of the side legs may be connected with a brace 13. The block has a top surface 15 and an undersurface 17. The undersurface 17 is flat at 19 under the middle leg 11. The flat undersurface 19 blends smoothly into a curved surface 2 under the side legs 9. The curved undersurface 21 joins the top surface 15 at a blunt point 23. The interior surface of the middle leg is preferably fabricated with serrations 25.

Pivotally connected between the block side legs 9 by a pin 27 is a foot 29. For clarity in FIGS. 2 and 3, a clearance is shown between the foot 29 and the associated block side legs, but in practice it is preferred that such clearance be kept to a minimum. The foot has a toe end 31 and a heel end 33. The toe end 31 terminates in a corner 35. The corner 35 and front surface adjacent the corner may be formed with serrations 39. To the foot heel end 33 is welded or otherwise joined a long handle 41. Alternately, the handle 41 may be fabricated integrally with the foot.

The handle 41 and foot 29 are pivotable together about pin 27 such that the foot is locatable at an open configuration best shown in FIGS. 1 and 3. In the open configuration, the foot toe end 31 is spaced from the serrations 25 of the block middle leg 11 by a space indicated at reference numeral 43. The handle and foot are rotatable clockwise with respect to FIG. 1 to place the foot in a closed configuration whereat the foot corner contacts the block middle leg serrations 25.

In use, the foot 29 is placed in the open configuration, FIGS. 1 and 3. The space 43 is positioned over the shank of a selected nail 3 to be pulled from the board 5 or the like. The puller is lowered over the nail until the block flat undersurface 19 is against the back surface 44 of the board 5. Then the handle is pivoted clockwise with respect to FIG. 1 such that the foot approaches the closed configuration. In doing so, the shoe toe corner 35 contacts the nail shank, and the shank becomes gripped between the serrations 39 of the foot and the serrations 25 of the block middle leg. Preferably, the nail is gripped as close as possible to the board surface.

A clockwise force is then applied to the handle 41. As a result, the serrations 35 and 39 tightly grip the nail, and a lever action occurs. The force F is resisted by the nail 3, and a fulcrum is created between the board back surface 44 and the block undersurface 17 at location R adjacent the nail. The fulcrum R is preferably at the tangent point between the block flat and curved undersurfaces 19 and 21, respectively. The lever has a large mechanical advantage, with one lever arm extending between the fulcrum R and the free end 45 of the handle, and the other lever arm extending between the fulcrum R and the shoe toe corner 35. When sufficient force is applied to the handle end 45, the entire puller 1 rotates as a unit about fulcrum R. As the puller 1 rotates clockwise about the fulcrum R, the block rolls on the board back surface 44 along the curved undersurface 21, FIG. 5, and the nail is pulled from the board.

Figure 5:
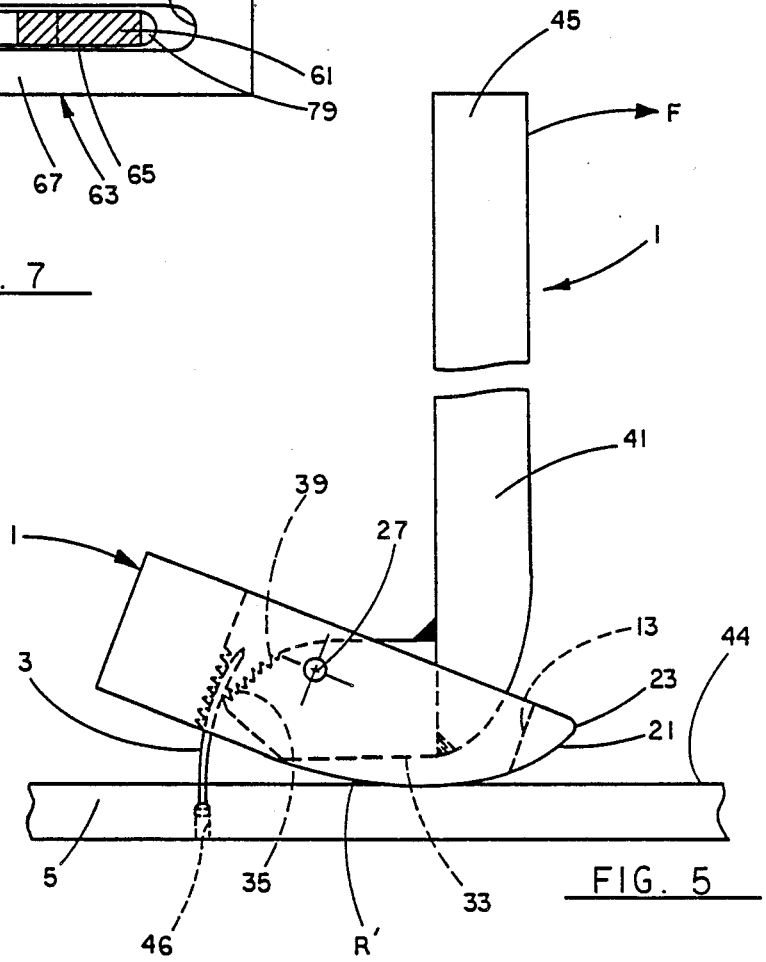

Because the block 7 rolls along the board 5 during the nail pulling operation, the fulcrum R changes location along the block undersurface 21. In FIG. 5, for example, the fulcrum is at point R' rather than at the original point R. As a result, the mechanical advantage of the nail puller 1 decreases as the nail 3 is extracted further from the board.

It is a feature of the present invention that the nail puller 1 can pull a long nail 3 from a board 5 or the like with a relatively constant and high mechanical advantage and with only minimum bending of the nail and elongation of the nail hole 46. That is achieved by applying a series of short ratchet-like motions to the handle 41. After the puller has been manipulated as previously described to pull the nail a short distance out of the board, the handle is pivoted in the counterclockwise direction with respect to FIG. 5. As a result, the nail shank is released from between the serrations 25 and 39 of the block and foot, respectively. The handle, block 7, and foot 29 are pivoted counterclockwise to the open configuration of FIG. 1. Pivoting the handle and foot to the closed configuration of FIG. 4 enables the serrations to get another a bite on the nail shank proximate the board surface 44. The fulcrum R also returns to the original location of FIG. 4 for maximum mechanical advantage. Applying the force F again in the clockwise direction pulls the nail further from the hole 46 with minimal effort. In that manner, a series of relatively small ratchet-like operations enables the nail to be pulled almost straight out of the board, thereby reducing the pulling force required and causing minimum damage to the board or other decorative member. The nail puller 1 works very well with finishing nails, even in hardwoods, as the heads of the nails are quite small. In addition, the nail puller also works well with box and common nails in softwoods.

Figure 6:
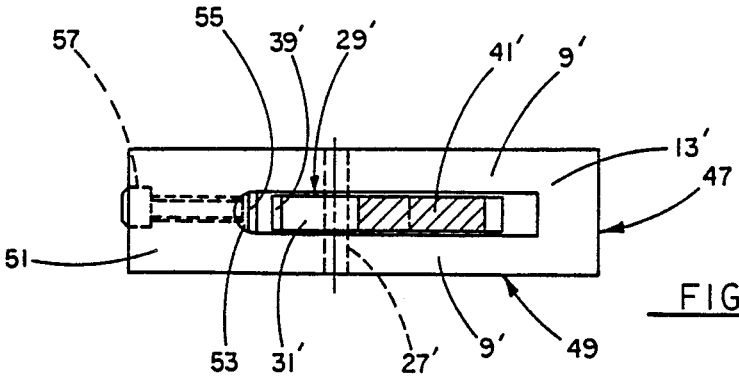
FIG. 6 is a view similar to FIG. 3, but showing a modified embodiment of the present invention.

Now looking at FIG. 6, a portion of a modified puller 47 is depicted. The puller 47 is similar in many respects to the puller 1 previously described, having a foot 29' and a handle 41'. The foot 29' is pivotally connected by a pin 27' to a block 49. The block 49 has parallel side legs 9' and a middle leg 51. The free ends of the block side legs 9' may be joined with a brace 13'. To cooperate with the serrations 39' of the foot toe end 31', the puller 47 includes a hardened strip 53. In the illustrated construction, the strip 53 has a semi-circular cross section with a flat side that is formed with serrations 55. The strip is fastened in place on the block 49 with one or more screws 57. Other than the serrated strip, the block 49 is similar in all respects of construction and function to the block 7 described in conjunction with FIGS. 1-5.

As another alternative, the serrations 39 on the foot 29 of either the puller 1 or the puller 47 may be constructed as a separate piece that is fastened to the toe end of the foot. That variation is particularly suitable if the foot and handle 41 are formed as a single component.

FIG. 7 shows the block 59 and a part of the handle 61 of a further modified puller 63. The block 59 has a rectangular outline with a slot 65 bounded by side legs 67. The foot 69 pivots within the slot 65 by means of a pin 71. The foot toe end 73, which may have serrations 75, is rounded, as, for example, a semi-circle. The end 77 of the slot 65 is also rounded to complement the foot toe end 73. If desired, the foot heel end 79 and slot end 81 may also be rounded.

Thus, it is apparent that there has been provided, in accordance with the invention, a nail puller that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tool for pulling nails from a board or the like comprising:

a. a block having a pair of spaced side legs with respective first and second ends, and a middle leg joining the first ends of the side legs, the middle leg having a flat undersurface, each side leg having a flat undersurface at the first end thereof that is coplanar with the middle leg undersurface and a convex undersurface that extends between the flat undersurface of the first end and the second end;

b. a foot having a toe and a heel;

c. pin means for pivotally connecting the foot between the block side legs at a location closer to the first ends thereof than to the second ends thereof; and d. a handle joined to the foot heel and extending at a generally right angle to the foot to form a generally L-shaped member, the handle and foot being pivotable together between an open configuration whereat the foot toe and the block middle leg define a space therebetween for receiving a nail shank and a closed configuration whereat the foot toe and the block middle leg cooperate to grip the nail shank therebetween, so that the handle can be pivoted to a first position to place the foot in the open configuration and the flat undersurfaces of the block middle leg and the first ends of the side legs can be set on the board or the like with a nail between the foot toe and the block middle leg and with the convex undersurfaces of the block side legs being out of contact with the board or the like, and the handle can be pivoted to a second position to place the foot in the closed position, and the handle can be pivoted to a third position to cause the block and foot to rotate together along the board or the like and roll from the flat undersurfaces of the block middle leg and the first ends of the side legs to the convex undersurfaces of the block side legs to pull the nail from the board or the like.

2. A nail puller comprising:

a. a block comprising:

i. a middle leg having a flat undersurface; and ii. a pair of side legs having respective first ends joined to the middle leg and respective second ends remote therefrom, the side legs defining a space therebetween, the side legs having respective flat undersurfaces at the first ends thereof that are coplanar with the middle leg undersurface, the side legs having respective convex undersurfaces that extend from the flat undersurfaces at the first ends to the second ends thereof;

b. a foot pivotally connected between the block side legs; and c. handle means joined to the foot for pivoting the foot between an open configuration whereat a space is defined between the foot and the back middle leg for receiving a nail and a closed configuration whereat the foot and the block middle leg grip the nail therebetween, and for rotating the foot and block together to roll along the convex undersurfaces of the block side legs from the first to the second ends thereof and thereby pull the nail gripped between the block middle leg and the foot.

* * * * *